United States Patent [19]

Harandi

[11] Patent Number: 4,994,168

[45] Date of Patent: Feb. 19, 1991

[54] LUBE OIL PRODUCT STRIPPING

[75] Inventor: Mohsen N. Harandi, Lawrenceville, N.J.

[73] Assignee: Mobil Oil Corporation, Fairfax, Va.

[21] Appl. No.: 260,637

[22] Filed: Oct. 21, 1988

[51] Int. Cl.[5] ..... C10G 71/00

[52] U.S. Cl. ..... 208/19; 208/18; 208/58; 208/87; 208/88; 208/97; 208/95; 208/100; 208/102; 208/111; 208/177; 208/354; 208/355; 208/356; 208/357

[58] Field of Search ..... 208/18, 19, 58, 87, 208/88, 97, 100, 102, 354, 355, 356, 357, 363, 111, 95, 177

[56] References Cited

U.S. PATENT DOCUMENTS

| | | | |
|---|---|---|---|
| Re. 28,398 | 4/1975 | Chen et al. | 208/111 |
| 3,894,938 | 7/1975 | Gorring et al. | 208/97 |
| 4,082,647 | 4/1978 | Hutchings et al. | 208/18 |
| 4,181,598 | 1/1980 | Gillespie et al. | 208/58 |
| 4,259,170 | 3/1981 | Graham et al. | 208/33 |
| 4,372,839 | 2/1983 | Oleck et al. | 208/97 |
| 4,437,975 | 3/1984 | Gillespie et al. | 208/97 |

*Primary Examiner*—Anthony McFarlane
*Assistant Examiner*—Nhat Phan
*Attorney, Agent, or Firm*—Alexander J. McKillop; Charles J. Speciale; Laurence P. Hobbes

[57] ABSTRACT

The quality and yield of dewaxed, hydrotreated lube oil base stocks are improved by reducing the top temperature in the hydrotreated lube stripper so as to increase the proportion of heavy kerosene components in the lube oil base stock. The separation system provides for a two stage stripping of the lube oil fraction such that the kerosene fraction stripped from the lube product in the primary product stripper under vacuum is stripped in a second stage stripper at a higher pressure with recycle of the heavy kerosene fraction as a reflux stream to the primary vacuum stripper so that a product with improved viscosity index and flash point is separated in the primary stripper.

19 Claims, 2 Drawing Sheets

LUBE OIL PRODUCT STRIPPING

FIELD OF THE INVENTION

This invention relates to the manufacture of lubricating oil from crude petroleum.

BACKGROUND OF THE INVENTION

The refining of petroleum crude oils to obtain a variety of lubricating oils which function effectively in various environments has become a highly developed process. Although the broad principles involved in refining are qualitatively understood, there are quantitative uncertainties which require considerable resort to empiricism in practical refining. Underlying these quantitative uncertainties is the complexity of the molecular constitution of lubricating oils. Because lubricating oils for the most part are based on petroleum fractions boiling above about 232° C. (450° F.), the molecular weight of the hydrocarbon constituents is high and these constituents display many conceivable structures and structure types. This complexity and its consequences are referred to in "Petroleum Refinery Engineering,: by W. L. Nelson, McGraw Hill Book Company, Inc., New York, NY 1958 (Fourth Edition).

In the production of lubricants a suitable crude oil which contains a quantity of lubricant base stock having a predetermined set of properties such as, for example, viscosity, oxidation stability, and maintenance of fluidity at low temperatures is subjected to a set of subtractive unit operations which removes the unwanted components. The most important of these unit operations include distillation, solvent refining, and dewaxing, which except for catalytic dewaxing, are physical separation processes in the sense that if all the separated fractions were recombined the original crude would be reconstituted.

A lubricant base stock (i.e., a refined oil) may be used as such as a lubricant, or it may be blended with another lubricant base stock having somewhat different properties. Or, the base stock, prior to use as a lubricant, may be compounded with one or more additives which function, for example, as antioxidants, extreme pressure additives, and viscosity index (V.I.) improvers. As used herein, the term "stock", regardless whether or not the term is further qualified, will refer only to a hydrocarbon oil without additives. The term "raw stock" will be used herein to refer to an untreated viscous distillate or the residuum fraction of crude petroleum oil isolated by vacuum distillation of a reduced crude from atmospheric dilstillation, or its equivalent. The term "solvent-refined stock" or "raffinate" will refer to an oil that has been solvent extracted, for example, with furfural. The term "dewaxed stock" will refer to an oil which has been treated by any method to remove or otherwise convert was contained therein and thereby reduce its pour point. The term "waxy," as used herein, will refer to an oil of sufficient was content to result in a pour point greater than −4° C. (25° F.). The term "stock", when unqualified, will be used to refer to the viscous fraction in any stage of refining, but in all cases free of additives. The term "base stock" will refer to an oil refined to a point suitable for some particular end use, such as for preparing automotive oils.

Conventional practice for the preparation of high grade mineral lubricating oil base stocks is to vacuum distill an atmospheric tower residuum from an appropriate crude oil as the first step. This step provides one or more raw stocks typically within the boiling range of about 290° to 565° C. (550° to 1050° F.) and a vacuum residuum. Each raw stock is then extracted with a solvent, e.g., furfural, phenol or N-methyl pyrrolidone, which is selective for aromatic hydrocarbons, and which removes the undesirable aromatic components. The vacuum residuum usually requires an additional deasphalting step to remove asphaltic material prior to solvent extraction. The raffinate from solvent refining is then catalytically dewaxed.

In recent years techniques have become available for catalytic dewaxing of petroleum stocks. A process of that nature developed by British Petroleum is described in The Oil and Gas Journal dated Jan. 6, 1985, at pages 69–73. See also U.S. Pat. No. 3,668,113. In U.S. Pat. No. Re. 28,398 is described as a process for catalytic dewaxing with a catalyst comprising zeolite ZSM-5. Such a process combined with catalytic hydrofinishing is described in U.S. Pat. No. 3,894,938. Catalytic dewaxing of raffinate using intermediate pore size zeolite catalysts such as ZSM-5 is described in U.S. Pat. Nos. 4,181,598 and 4,259,170.

The manufacture of lube oil base stocks is designed to produce a lube product according to very strict specifications for pour point, viscosity, viscosity index (V.I.) and product flash point. Often, improvements in one or more of these product parameters can be achieved only by adversely affecting other product parameters. However, if improvements can be realized in the product viscosity index, for instance, without adversely affecting the remaining product parameters, substantial benefits may accrue. Similarly, if an improvement in the downstream processing of the lube oil can be achieved so as to produce a lube oil stock with one or more properties exceeding the required specifications, the refinery operator is provided with a greater variety of options on how to exploit the improved performance, with the potential for improving the economic performance of the refinery.

SUMMARY OF THE INVENTION

We have now devised an improved process for manufacturing lube oil stock which is capable of leading to the enhancement of the yield and viscosity index of the stock by the process produced.

Lube oil stocks of improved viscosity index can be manufactured with improved yields by modifying the fractionation of catalytically dewaxed lube oil stocks. Generally, these stocks will be derived from the process operations of solvent extraction, catalytic dewaxing and hydrotreating. It has been found that the viscosity index and yield of finished lube oil stocks are improved if the lube contains a higher amount of a heavy kerosene fraction.

The process for producing the catalytically dewaxed lube product of improved characteristics comprises catalytically dewaxing a lube boiling range feed over a dewaxing catalyst, hydrotreating the catalytically dewaxed lube product and fractionating the hydrotreated product fraction boiling above the naphtha boiling range to produce a distillate fraction boiling below the lube boiling range and a lube fraction. The process improvement comprises increasing the proportion of the higher boiling distillate fraction components in the lube fraction by stripping the hydrotreated product fraction under reduced (subatmospheric) pressure e.g., below 10 psia to form a kerosene fraction and a higher boiling lube fraction and fractionating the kerosene fraction under a relatively higher pressure to form a light kerosene fraction and a heavy kerosene fraction. The heavy kerosene fraction may then be combined with the higher boiling lube fraction to form a lube stock of reduced viscosity and improved viscosity index.

The product separation system for the lube oil comprises a primary steam stripping vessel, preferably containing low pressure drop packing, with an inlet for receiving the lube oil stock in its mid-portion and a bottom inlet for stripping steam. This vessel is operated under reduced pressure e.g., a vacuum of 2-3 psia. An outlet connected at the top portion of the stripper for the overhead effluent stream is provided and this is connected to a cooler for the overhead. A liquid/vapor separator is connected to the cooler for separating the liquid and vapor components of the overhead stream. A secondary fractionating vessel which operates at a relatively higher pressure, usually about atmosphere, is used to fractionate the kerosene fraction into its light and heavy components. The fractionator is suitably provided with a bottom inlet for a stripping medium such as steam and is connected to the separator by an inlet in the upper portion of the fractionator so as to receive the overhead liquid component from the separator. A bottom outlet from the secondary fractionator is connected to the top portion of the primary stripping vessel so that the bottom effluent stream from the secondary fractionator is transferred to the primary stripper preferably as reflux. A second cooler is connected to the top portion of the secondary stripper for cooling its overhead stream and a second liquid/vapor separator is connected to the second cooler for separating the liquid and vapor components of the cooled overhead stream from the secondary stripper The vacuum on the primary stripper may be maintained by a vacuum pump with an inlet connected to the vapor side of the liquid/vapor separator. The outlet of the pump is preferably connected to the secondary fractionator circuit either at the feed to the fractionator or at the overhead from it in order to minimise the amount of vapor product leaving the system and, in the conventional refinery, being burned in a waste burner. Pressure in the secondary fractionator is suitably above atmospheric.

THE DRAWINGS

DETAILED DESCRIPTION

Figure 1:
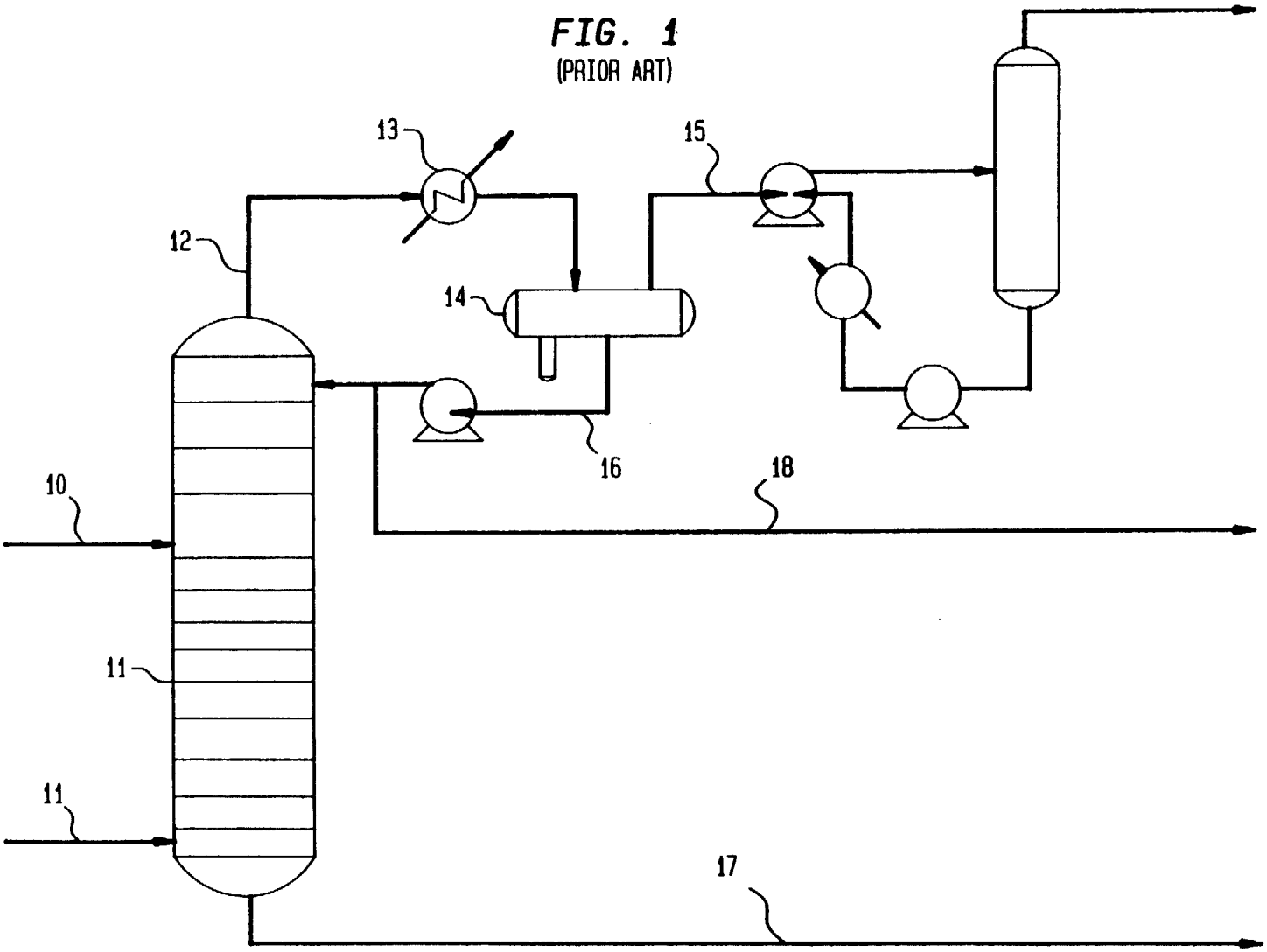
FIG. 1 (PRIOR ART)
FIG. 1 is a schematic drawing of a conventional lube oil product stripper.

Wax based crude oils, sometimes called paraffin base crude oils, are preferably utilized to provide the raw charge stock from which lube oil base stocks are produced. The wax base crudes represent a well organized class of crude petroleum. However, the present invention is applicable to a wide range of waxy crudes. After fractionation in the atmospheric and vacuum towers, the raw stock is subjected to solvent extraction to remove undesirably aromatic components. The severity of extraction is adjusted to the composition of the charge stock to meet specifications for the particular lube base stock which is to be made; this severity will be determined in accordance with established practices.

The raffinate from the solvent extraction step is catalytically dewaxed, preferably over an intermediate pore size zeolite such as ZSM-5, ZSM-11 or ZSM-23 in the presence of hydrogen typically at temperatures from 500° to 675° F. Catalytic dewaxing processes of this type are now well established, especially the Mobil lube Dewaxing Process (MLDW) as described, for example, in U.S. Pat. Nos. Re 28,398, 3,894,938, 4,181,598 and 4,259,170. See also Catal. Rev. - Sci. Eng. 28 (243), 185-264 (1986), especially 244-247 and Petroleum Processing Handbook, 1986, Hydrocarbon Processing, September 1986, page 90, to which publications reference is made for typical descriptions of such processes.

The intermediate pore size zeolite dewaxing catalysts are usually combined with a metal hydrogenation component, typically a metal of Group VIIIA (IUPAC Table). The zeolites themselves are characterised by a Constraint Index of 1 to 12. The determination of "constraint index" is described in U.S. Pat. No. 4,181,598.

This class of zeolites is exemplified by ZSM-5, ZSM-11, ZSM-12 and ZSM-35, and other similar materials. ZSM-5 is described in U.S. Pat. No. 3,702,886; ZSM-11 in U.S. Pat. No. 3,709,979, ZSM-12 in U.S. Pat. No. 3,832,449; and ZSM-35 in U.S. Pat. 4,016,245, to which reference is made for a disclosure of these zeolites.

In the catalytic dewaxing step olefins are produced and large waxy molecules in the charge are cracked to produce lighter fractions that include light and heavy kerosene components. As the presence of olefins would destabilize the lube oil base stock the catalytic dewaxing reaction products are passed to a hydrotreater containing, as catalyst, a hydrogenation component on a non-acidic support, such as cobalt-molybdate or nickel-molybdate on alumina. The catalytic dewaxing reaction effluent is typically hydrotreated in the broad range of about 400°-600° F. (205°-315° C.).

After catalytic dewaxing and hydrotreating the effluent of the hydrotreater is conventionally topped by distillation, i.e., the most volatile components are removed to meet the flash point specification. As noted above, low boiling components in the raw dewaxing stock are augmented by components of similar boiling point produced during the course of the catalytic dewaxing step. These additional low boiling components which after hydro-treating, comprise a predominately heavy kerosene boiling fraction, are typically passed to a steam stripper for separation to produce the final lube oil base stock meeting the required specifications for pour point, flash point, viscosity, viscosity index, etc.

It has been discovered that when the stripper top temperature is reduced below conventional operating temperatures to a temperature at which the heavy components of the kerosene fraction are dropped into or remain with the lube product, the quality of the lube base stock is improved with respect to viscosity index and the overall yield of lube product is increased. The heavy components that are dropped into the lube product are thought to be predominately heavy kerosene components that are formed by cracking during the catalytic dewaxing step.

Referring to FIG. 1, a schematic diagram of a conventional vacuum stripper used in the separation of the catalytically dewaxed and a hydrotreated lube product is shown. The raw lube product having a boiling range between about 400° and 1065° F. following hydrotreating is passed in line 10 to the mid portion of a vacuum stripper II typically operating at a pressure of 30 kPa with vacuum maintained by means of pump 19 with the overhead passing out of the system.

In a conventional operation the top temperature is held from 360° to 420° F. (from 182° to 216° C.) to provide a kerosene overhead stream in line 12 which passes through heat exchanger 13 and, after cooling, is separated in vapor/liquid separator 14 to provide a vapor stream in line 15 and liquid stream in line 16. A portion of the liquid stream in line 16 is refluxed to the stripper. Lube base stock is withdrawn from the stripper from a bottom outlet through conduit 17 and the liquid kerosene fraction is withdrawn from separator 14 through conduit 18. A typical light neutral lube oil stock withdrawn is characterized by a minimum flash point of about 445° F. (230° C.), viscosity of about 40 cSt at 40° C., and viscosity index of at least about 90, usually at least 93. The overall stripper lube yield is between about 94 to 99 percent of the feed to the stripper.

If the top distillation temperature is reduced to about 300° F. (about 150° C.) in stripper 11, the lube base stock produced under these conditions of reduced top distillation temperature will be characterized by having a minimum flash point of about 405° F. (207° C.), a viscosity typically about 38 cSt at 40° C. and a V.I typically 2 numbers higher than the previously described lube base stock. The lube yield is increased by about 1 percent at the expense of a corresponding decrease in the kerosene yield.

While the addition of the lower boiling components to the lube fraction in this way will provide improvement in the yield and properties of the lube oil base stock, the kerosene reflux liquid recycled to the stripper inevitably contains a significant portion of light kerosene, some of which will be incorporated in the lube base stock produced. This works to the disadvantage of the product by lowering the flash point of the product as well as adversely affecting other key specification parameters.

Because the flash point is an important product specification for safety reasons, the lube manufacturer has frequently been forced to forgo the advantages accruing from a low stripper top temperature in order to ensure that the product conforms to the required minimum flash point. Frequently this has resulted in "flash-point giveaway" or an excessively high flashpoint, at the expense of lube yield and V.I., to ensure that flash point specification is consistently met. This is clearly disadvantageous.

Figure 2:
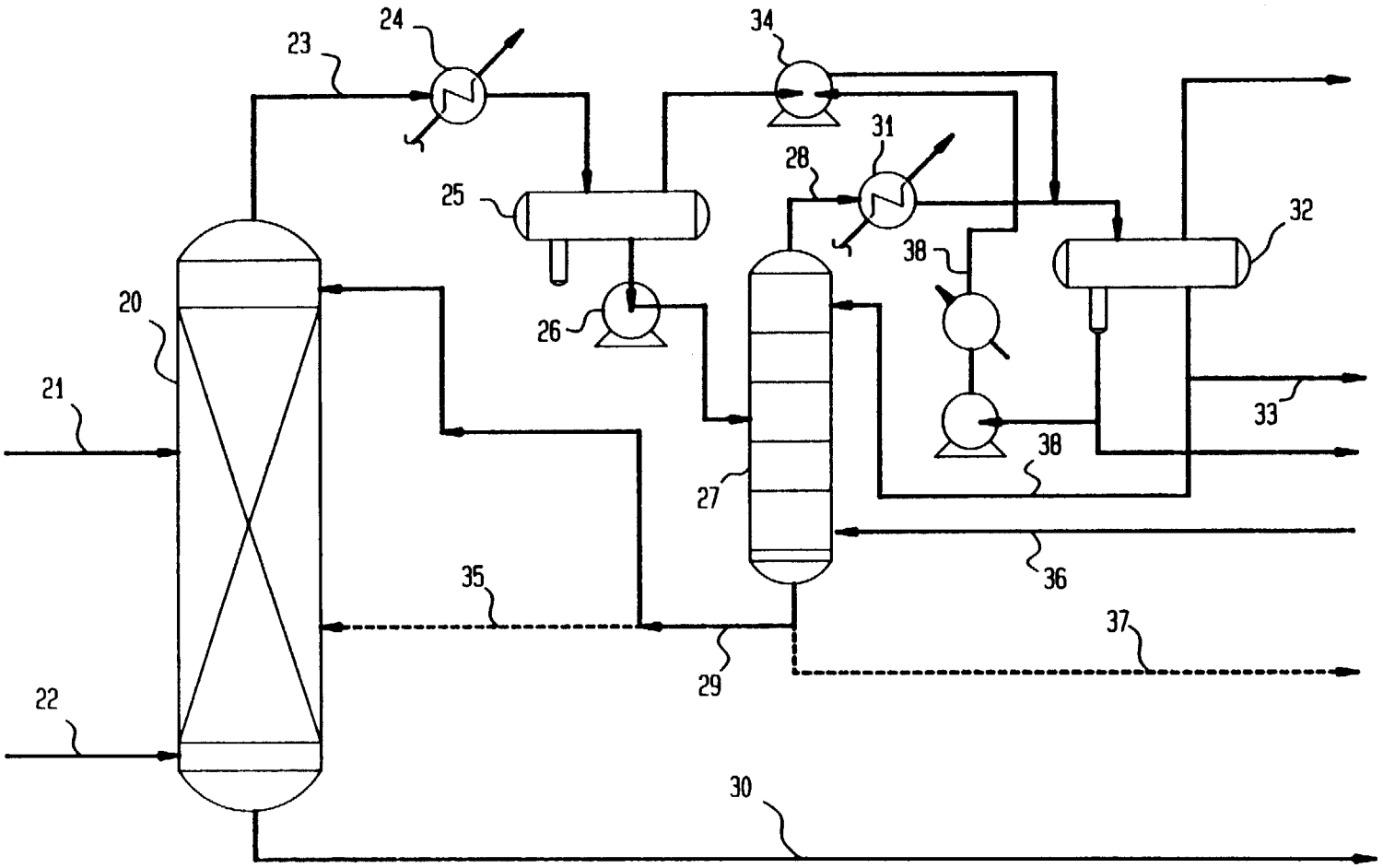
FIG. 2 is a schematic drawing of an improved two-stage product stripper.

FIG. 2 shows a lube stripper system which overcomes these disadvantages and promotes better separation of the light kerosene components from the lube. In FIG. 2, vertical vacuum stripper 20 has an inlet for receiving the raw lube product from hydrotreating in a mid-portion of the stripper through conduit 21. The stripper contains a low pressure drop distillation packing. Steam is introduced to the bottom portion of the stripper through an inlet connected to steam line 22 and overhead fraction comprising essentially kerosene is withdrawn through a top outlet and conduit 23. The top distillation temperature in the product stripper is typically between about 260° to 360° F. (about 127° to 182° C.), at an operating pressure of 10 to 100 kPa, preferably 15 to 150 kPa, say of about 2–3 psia (13–20 kPa). The low operating pressure prevailing in this part of the unit assists in the removal of light ends from the lube fraction. The overhead kerosene effluent is cooled in heat exchanger 24 and passed to vapor/liquid separator 25. From the vapor/liquid separator a liquid portion passes through pump 26 to secondary fractionator 27, suitably a steam stripper, which is equipped to receive the liquid portion of the kerosene in the middle or upper portion of the fractionator. Preferably all the liquid hydrocarbons from separator 25 are passed to the secondary fractionator. Steam is supplied through line 36. In secondary fractionator 27 the liquid kerosene fraction is fractionated under higher pressure (110 to 300 kPa) to provide a light overhead kerosene fraction withdrawn through line 28 and a bottom fraction withdrawn through line 29 comprising heavy kerosene which is passed to the top portion e.g., the top tray of the primary product stripper through an inlet at the proper level. Optionally, at least a portion of the separated heavy kerosene fraction may be returned to the lower portion of the primary stripper (below the lube inlet) through line 35 or withdrawn through line 37. The product lube oil base stock is withdrawn from the primary stripper through line 30 at the bottom portion of the stripper. A typical light neutral lube oil base stock is characterized by a minimum flash point of about 405° F. (207° C.), a viscosity of about 36 to 38 cSt at 40° C. and a viscosity index of at least about 90, usually at least about 94. Preferably, the lube product does not have a flash point below 350° F.

A portion of the liquid effluent from separator 32, preferably a portion of 350° to 580° F., the aqueous phase, is passed to pump 34 through line 38 to provide a liquid seal. Alternatively, a portion of the feed to the second cooler may be used for this purpose. Column reflux is provided by light kerosene entering the top of the column from line 39.

The stripper system illustrated in FIG. 2 effectively relieves the limit on kerosene components that can be blended into the lube product as dictated by the need to control the lube base stock flash point and/or viscosity. By removing the light ends from the primary stripper reflux in addition to returning the heavy kerosene components into the stripper, lube yield and VI are significantly improved while still meeting product flash point specifications. This mode of operation substantially eliminates refluxing relatively light components which significantly reduce the product flash point and viscosity. The design also minimizes the hydrocarbon lost to fuel gas by recontacting the vacuum stripper vapor with the lube oil dewaxing kerosene at atmospheric pressure. Another advantage of the system is that it enables the kerosene content of the lube base stock to be maximised which, in turn, minimises lube viscosity while allowing product viscosity specification to be met as feed viscosity is increased. In this way, the crude vacuum lower cut points can be adjusted to give a higher cut point so that a more economical operation may be achieved whenever the lube base stock is determining the crude run rate.

In examples utilizing the process of the present invention a lube oil base stock was produced from an Isthmus crude. The product yield improved by 1% and the product viscosity index increased from 96 to 98 when the lube oil dewaxing stripper top temperature was reduced. The overall dewaxing unit viscosity uplift was reduced from 2.536 to 2.509. Producing a lube oil base stock from an Arabian light crude the yield was increased by 1% and the product and viscosity index was increased from 95 to 98 when the visocity uplift was reduced from 2.674 to 2.555.

What is claimed is:

1. In a process for producing a catalytically dewaxed lube product of improved characteristics by catalytically dewaxing a lube boiling range feed over a dewaxing catalyst, hydrotreating the catalytically dewaxed lube product and fractionating the hydrotreated product fraction boiling above the naphtha boiling range to produce a distillate fraction boiling below the lube boiling range containing a kerosene fraction comprising light kerosene and heavy kerosene fractions, and a lube fraction, the improvement which comprises increasing the proportion of heavy kerosene fraction components in the lube fraction by stripping the hydrotreated product fraction under subatmospheric pressure to form a kerosene fraction and a higher boiling lube fraction, fractionating the kerosene fraction to form a light kerosene fraction and a heavy kerosene fraction and combining the heavy kerosene fraction with the higher boiling lube fraction.

2. A process according to claim 1 in which the hydrotreated product fraction is stripped at a pressure of 10 to 100 kPa.

3. A process according to claim 2 in which the kerosene fraction is fractionated at a pressure of 110 to 300 kPa to form the heavy and light kerosene fractions.

4. A process according to claim 1 in which the proportion of the heavy kerosene fraction combined with the higher boiling lube fraction is such that the combined lube product does not have a flash point below 350° F.

5. A process according to claim 1 in which the proportion of the heavy kerosene fraction combined with the higher boiling lube fraction is such that the combined lube product does not have a viscosity below 30 cSt at 40° C.

6. A process according to claim 1 in which a portion of the heavy kerosene fraction is returned to the stripping step.

7. A process according to claim 1 in which the kerosene fraction is fractionated into the heavy and light kerosene fractions while being stripped with a stripping medium.

8. A process according to claim 7 in which much of the stripping medium present in the fractionation of the kerosene is steam.

9. A process according to claim 1 in which the hydrotreated lube fraction is stripped in the presence of steam as a stripping agent to form the kerosene fraction and the lube fraction.

10. A process according to claim 1 in which the proportion of the heavy kerosene fraction combined with the higher boiling lube fraction is such that the combined lube product does not have a flash point below 350° F. and a viscosity below 30 cSt at 40° C.

11. A process for the preparation of lubricating base stock oil of improved viscosity index from waxy crude oil, comprising:

(a) distilling said waxy crude oil to provide a raw lube oil stock with a boiling range between about 400° to 1065° F.;

(b) solvent extracting the raw lube oil stock to produce a raffinate of reduced aromatic hydrocarbon content;

(c) catalytically dewaxing the raffinate under dewaxing conditions in contact with a dewaxing catalyst comprising an aluminosilicate zeolite having a silica/alumina ratio of at least about 12 and a Constraint Index of about 1 to 12, to convert wax contained in the raffinate to hydrocarbons boiling below the lube boiling range;

(d) hydrotreating the dewaxed raffinate in contact with a hydrotreating catalyst and hydrogen;

(e) separating the hydrotreated, dewaxed raffinate to form a naphtha fraction and a heavier fraction;

(f) passing the heavier fraction to a vacuum steam stripping vessel and stripping it to form a lube fraction and kerosene fraction containing a heavy kerosene component and a light kerosene component;

(g) steam stripping the kerosene fraction in a fractionator under a higher pressure than the stripping step to form a light kerosene fraction and a heavy kerosene fraction;

(h) returning at least some of the heavy kerosene fraction to the vacuum steam stripping vessel whereby a portion of the returned heavy kerosene fraction is incorporated into the lube fraction withdrawn from the vacuum steam stripping vessel.

12. A process according to claim 11 wherein said base stock comprises lube oil base stock characterized by a flash point between 350° to 580° F., a viscosity above about 30 cSt at 40° C. and a viscosity index of at least 93.

13. A process according to claim 11 wherein the temperature at the top of the vacuum steam stripper is about 260° to 360° F. at a pressure of about 15 to 100 kPa.

14. A process according to claim 11 in which a portion of the heavy kerosene component separated in the fractionator is returned to the vacuum steam stripping vessel as reflux.

15. A process according to claim 11 in which a portion of the heavy kerosene component separated in the fractionator is returned to a lower portion of the steam stripping vessel.

16. A process according to claim 11 in which a portion of the light kerosene component is returned to the fractionator as reflux.

17. A process according to claim 11 in which the proportion of the heavy kerosene fraction combined with the higher boiling lube fraction is such that the combined lube product does not have a flash point below 350° F.

18. A process according to claim 11 in which the proportion of the heavy kerosene fraction combined with the higher boiling lube fraction is such that the combined lube product does not have a viscosity below 30 cSt at 40° C.

19. A process according to claim 11 in which the heavier fraction is steam stripped at a pressure of 10 to 100 kPa and the kerosene fraction is steam stripped in the fractionator at a pressure of 110 to 300 kPa.

* * * * *